US005915851A

United States Patent [19]

Wattrick et al.

[11] Patent Number: 5,915,851

[45] Date of Patent: Jun. 29, 1999

[54] WATER DISPENSING AND DRAINING APPLIANCE

[75] Inventors: Douglas Wattrick, South Haven; Karen L. Wells, Caledonia, both of Mich.

[73] Assignee: Whirlpool Corporation, Benton Harbor, Mich.

[21] Appl. No.: 08/943,028

[22] Filed: Oct. 2, 1997

[51] Int. Cl.[6] ..... A47K 1/04

[52] U.S. Cl. ..... 4/619; 4/628; 4/630; 4/631; 4/638; 4/696

[58] Field of Search ..... 4/619, 628, 629, 4/630, 631, 639, 640, 696, 663

[56] References Cited

U.S. PATENT DOCUMENTS

| | | | |
|---|---|---|---|
| D. 156,281 | 11/1949 | Sandin . | |
| D. 225,403 | 12/1972 | Brendgord . | |
| D. 245,619 | 8/1977 | Robinson . | |
| D. 287,748 | 1/1987 | Landan et al. . | |
| 499,781 | 6/1893 | DeGroff . | |
| 1,224,838 | 5/1917 | Blissman et al. . | |
| 2,050,617 | 8/1936 | Litner | 4/36 |
| 2,178,411 | 10/1939 | Tietz | 4/630 |
| 2,314,157 | 3/1943 | O'Brien . | |
| 2,579,393 | 12/1951 | Modrey . | |
| 2,818,581 | 1/1958 | Miller | 4/630 |
| 2,847,681 | 8/1958 | Jacobs . | |
| 3,031,871 | 5/1962 | Bailey | 4/638 |
| 3,402,406 | 9/1968 | Kaiser . | |
| 3,451,068 | 6/1969 | Phillips, Jr. . | |
| 3,514,330 | 5/1970 | Schaap et al. . | |
| 3,728,746 | 4/1973 | Konen et al. . | |
| 4,336,619 | 6/1982 | Hinkel et al. . | |
| 4,457,031 | 7/1984 | Moore . | |
| 4,653,128 | 3/1987 | Canalizo . | |
| 4,654,900 | 4/1987 | McGhee . | |
| 4,739,781 | 4/1988 | Casoli . | |
| 4,761,839 | 8/1988 | Ganaway . | |
| 4,884,725 | 12/1989 | Ahad et al. . | |
| 4,902,153 | 2/1990 | Luke . | |
| 4,919,162 | 4/1990 | Lumby et al. . | |
| 5,029,606 | 7/1991 | Kuhlthau, Jr. . | |
| 5,073,997 | 12/1991 | Rabe . | |
| 5,118,010 | 6/1992 | Jeans . | |
| 5,193,562 | 3/1993 | Rigby et al. . | |
| 5,265,284 | 11/1993 | Dottori et al. . | |
| 5,287,570 | 2/1994 | Peterson et al. . | |
| 5,359,820 | 11/1994 | McKay . | |

*Primary Examiner*—David J. Walczak
*Attorney, Agent, or Firm*—Hill & Simpson

[57] ABSTRACT

A water appliance of a modular construction including a basin module having attachable wing modules, a cabinetry module having cabinet doors to match surrounding kitchen cabinetry or appliances, a utility module for containing water, electrical, and electronic conduits from counter level down to below the basins, a garbage disposer module flow connected to drains of the basin and pre-piped for drainage, and a control module connected to a top of the utility module and quickly connectable to water, electrical, and electronic conduits from the utility module. The control module provides a light for the basin area as well as water dispensing conduits which can be precisely electronically controlled for water delivery, flow rate, quantity, temperature, $CO_2$ content, purity level, detergent level, etc. A hand held brush extending from the controller module by a flexible hose can be provided and its controls applied onto the control panel of the controller module. A separate water conduit for drinking water can be provided with controls for purity, $CO_2$ content, temperature, quantity, flow rate, etc. The modular design is effectively manufactured and installed and allows for flexibility in selecting options for the water appliance. The water appliance can be aesthetically integrated with the kitchen by appropriate selection of paneling and cabinetry.

20 Claims, 6 Drawing Sheets

WATER DISPENSING AND DRAINING APPLIANCE

BACKGROUND OF THE INVENTION

The present invention relates to a water dispensing and draining appliance and particular to such an appliance to be located in a food preparation area or kitchen. Currently, water supply and drainage for kitchen work is delegated to a kitchen sink having a faucet, perhaps a garbage disposal unit and a drainage pipe. Typically the sink is inconveniently sized with inadequate organization to facilitate the chores to be accomplished in the kitchen. Additionally, present sinks are typically provided as a retrofit unit for installation into built-in cabinetry through an opening in a counter top. Present kitchen sinks lack flexibility of design, lack useful features, and lack convenience and ability to be readily replaced with different models.

SUMMARY OF THE INVENTION

It is an object of the present invention to provide a water dispensing and draining appliance and food preparation area to replace current kitchen sinks. It is an object of the invention to provide a water appliance which provides convenient work areas and accessories for improving efficiency of labor in the food preparation area or kitchen. It is an object of the invention to optimize storage and accessory space within a cubic volume occupied by the appliance. It is an object of the invention to maximize efficiency in construction and installation of a complete modular water appliance. It is an object of the invention to provide a water appliance and food preparation area which allows for convenient location of controls for appliances such as a dishwasher, a disposer, and a water dispensing conduit. It is an object of the invention to provide a water appliance which has temperature controlled water supply for cold and hot water. It is an object of the invention to provide a water appliance which provides purified and carbonated water. It is an object of the invention to provide a water appliance having water supplied cleaning tools for cleaning pots and pans. It is an object of the invention to provide a water appliance having lighting means for illuminating the work area.

It is an object of the invention to provide a water appliance with water delivery within a water holding basin for flushing matter from the basin to a drain. It is an object of the invention to provide under work surface access areas for multiple selected uses such as chilled food storage, garbage disposal and waste management systems, water control systems, dishwashing facilities.

The objects of the invention are achieved by providing a water appliance of a modular design and construction. The water appliance provides a dual basin arrangement wherein drain lines from each basin are routed through a garbage disposal module which includes a mechanized disposer. On either side of the two basins are extender wing modules which provide either cutting board work surfaces or raised draining surfaces for drying dishes and which can be reversible for alternate selection. The wing modules can have a slidable cover for concealing the basins when the basins are not in use and to maximize counter areas on adjacent sides of the work station appliance. Above the basin is arranged a console with a light panel which can provide illumination for the appliance work area. Also arranged on the console are controls for selecting water temperature, dispensed volume, water velocity or water treatment such as $CO_2$ water or purified water. A hand held scrubber attachment can be provided and held on the console, such as a water supplied brush for scrubbing pots and pans. Storage areas are provided beneath the basins and are maximized in volume because the electrical and plumbing facilities are centralized and located at a back of the cabinet. The plumbing is modularized to maximize under sink working area. The front paneling of the water appliance is selectable to match or complement existing cabinets or appliances.

Also available as a part of the water appliance is a built in cooking surface arranged on a wing module for cooking items such as pasta and rice, which is particularly convenient for those items which need to be drained of hot water for serving. This features eliminates the need to move from the conventional cooking stove area to a conventional sink to drain water from these items. Additionally, a water plug-in supply can be provided on the water appliance surface to plug into water using appliances such as a coffee pot or vegetable steamer to dispense a correct amount of water in conjunction with the particular appliance control, to automate the cooking or preparing step. This can be used, for example, to fill and activate a coffee maker by a timer for early morning coffee.

Beneath the basin, a miniature refrigerator or a vegetable chiller bin can be provided. This is convenient for those items which need to be rinsed with water or otherwise cut for serving as it eliminates the transportation of these items from the conventional refrigerator to the conventional sink. The items are located in the chiller bin conveniently near the area where they are prepared, the appliance cutting boards or basins.

Additional features of the water appliance include a video display mounted on the console for accessing recipes or entertainment from television, video tapes or a computer while working at the station. Each basin can be provided with a jet wash to assist draining of the basin or assist the washing of items within the basin. Additionally, the console can be provided with a storage area for bulk soap or liquid soap and an automated dispenser including controls therefore. The water/soap mixture can be supplied to a hand held cleaning tool or to the basins.

Additionally, the cutting boards or drying boards can be provided with flushing water supply through apertures at an elevated end of the cutting board or draining board to flush the surface of the board into the basin.

The water appliance provides a modular construction including base cabinet, basin module, utility module, drain and disposer module, control module, plug in functional modules and modular storage bins. The appliance can be sold complete or upgraded by the homeowner with add on modules. The appliance can also be integrated with a dishwasher as a single appliance.

DETAILED DESCRIPTION OF THE PREFERRED EMBODIMENTS

Figure 1:
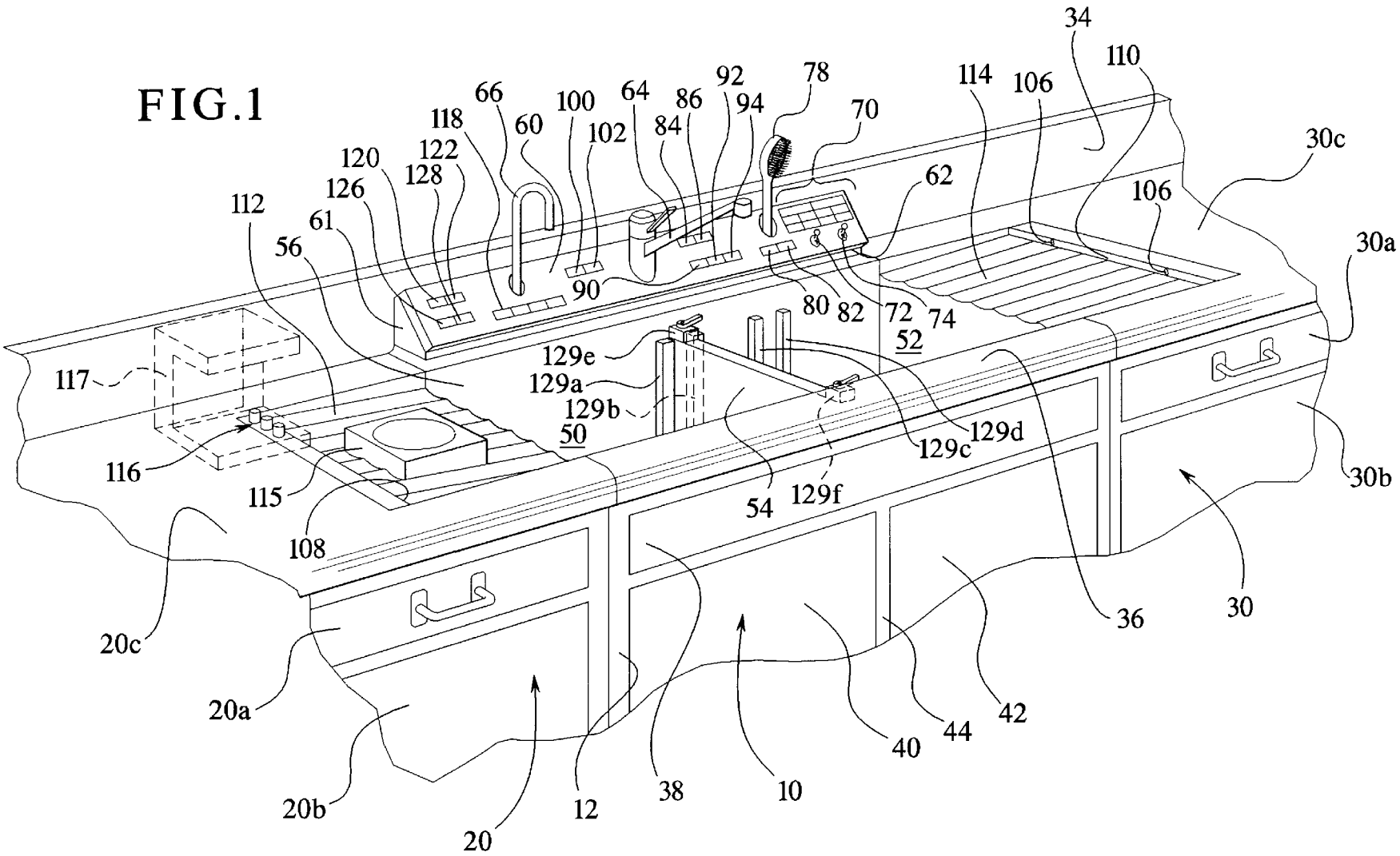
FIG. 1 is a partial perspective view of a water appliance and work station of the present invention.
Figure 3:
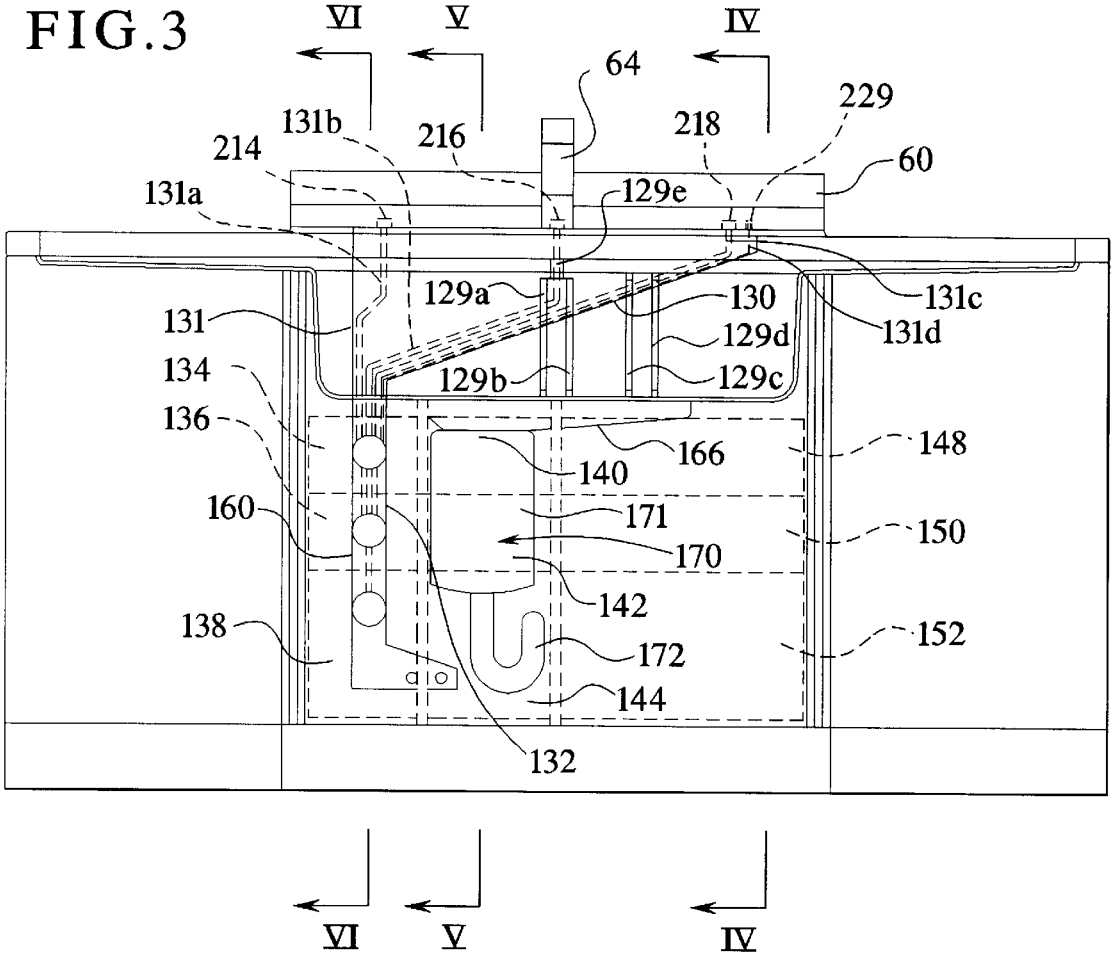
FIG. 3 is a sectional view taken generally along III—III of FIG. 2.

FIG. 1 illustrates a water appliance 10 having a base cabinet 12 mounted flushly to a first cabinet 20 and a second cabinet 30 such as to form an integral appearance of built-in cabinetry. The cabinets 20, 30 are typical kitchen-type cabinets having top drawers 20*a*, 30*a* and bottom doors 20*b*, 30*b* dividing a cubicle area beneath counter tops 20*c*, 30*c*. A back splash 34 connects the two cabinets 20, 30 spanning across the water appliance 10. The back splash 34 can be continuous or a separate piece behind the appliance. A further counter top strip 36 connects the counter tops 20*c*, 30*c* at a front side of the water appliance 10.

The base cabinet 12 is trimmed on a front side thereof by a front panel 38 and side by side cabinet doors 40, 42 closeable to a frame piece 44. The base cabinet 12 can be prepainted metal and can be similar in structural appearance to a washer or dryer. The base cabinet 12 has an open front with bracing 45 (FIG. 7) across the top, and a floor 46 (FIG. 7) at a same height as floors in adjacent cabinets. The front panel 38 and doors 40, 42 can be selected for visual integration into the kitchen decor.

The water appliance 10 provides side by side basins 50, 52 divided by a center wall 54 and supported on the base cabinet 12. Above a back wall 56 is arranged a console 60 mounted onto a control module 61. The console can be illuminated and particularly can be provided with a light bar on a downwardly facing surface 62 to illuminate the basins 50, 52. At a center of the console 60 protrudes a water dispensing conduit 64 which can be pivoted to service alternately basins 50, 52. Additionally, protruding from the console 60 is a drinking water faucet 66 which receives a supply of filtered or purified water from a source beneath the basins 50, 52 and behind the cabinet doors 40, 42 as described below. On one side of the console 60 is arranged a grid of control buttons 70 for controlling the operation of a remote dishwasher (not shown). By elevating these controls 70, a more natural posture can be maintained by the user to select the proper controls, rather than a more stooped position to access lower mounted dishwasher controls. The operation of the dishwasher can be coordinated with the other working activities of the water appliance.

First and second toggle switches 72, 74 are used to remotely open and close drains for the basins 50, 52 respectively by electro mechanical means (not shown). A water supplied brush 78 also is provided protruding from the console 60 and which can be retracted upwardly and outwardly by way of a flexible water supplying hose (not shown). The brush 78 is provided with water, clear or soapy, for scrubbing pots and pans, etc. Controls 80, 82 are provided to select between for example "china and crystal" or "pots and pans" and which adjusts the velocity of water from the brush 78.

The brush attachment is designed for those items that are currently hand washed. It can have two detachable heads, a gentle one for delicate items and a heavy duty one for removing stubborn burned on food. Soap is dispensed by pushing a button on the handle. The brush can be provided with a light in the end to direct a user to those areas that need cleaning. The light can be low voltage to prevent any inadvertent shocks.

The brush can also be adapted to receive connections for a water powered vegetable peeler, the cleaning brush or a scraper.

On/off controls 84, 86 are provided to control the garbage disposal. Light control push buttons for "on" 90, "auto" 92, and "off" 94 are provided for controlling the console light. The auto function can cause the console light to come on at a predetermined time or when the room becomes dark. Left and right flush controls 100, 102 respectively control a water jet flush (nozzles shown in FIG. 8 for example) of the basins 50, 52 to assist in removing debris from the basins to the drains. Alternately or cumulatively, flush nozzles 106 can be provided at the elevated plural ends 108, 110 of wing modules 112, 114 respectively. The wing modules 112, 114 can thus be used for food preparation or dish drying and can be rinsed down with nozzles 106 using the flush controls 100, 102.

One or both of the wing modules 112, 114 can be provided with a burner, such as a halogen burner 1 for food preparation. This allows spill-overs to drain into the basin 50 and also allows cooking water boiled items like pasta or rice near the basin for ease of draining. Thus, a trip with a pot of boiling water from the stove area to the basin area is avoided. Water, drain and electric plug connectors 116 can be provided to service a coffee maker 117 (shown in phantom). The coffee maker 117 can thus be controlled by the control module 61 for timed operation.

A temperature selector group of buttons 118 is provided to select a desired water temperature from the dispensing conduit 66. For example, the four buttons shown could represent 190°, 140°, 80° and 35° water. A reverse osmosis control on/off 120, 122 respectively is provided which will deliver pure water to the faucet 66 from a reverse osmosis unit under the basins (not shown). Additionally, a carbonated water on/off selector button 126, 128 respectively is provided for delivery of carbonated water for drinking and other purposes.

All controls in the control module 61 are low voltage to prevent electrical shock. As a further convenience, the center wall 54 can fit into U-shaped guide rails 129*a*, 129*b* which are arranged in vertical parallelism around an inside surface of the basins 50, 52. The guide rails 129*a*, 129*b* and/or the wall 54 are provided with sealing means at their interface. At a different position in the basins 50, 52, alternate guide rails 129*c*, 129*d* are provided, identically configured to rails 129*a*, 129*b*. The wall 54 can be placed at either location to change the relative sizing of the basins 50, 52. An alternative embodiment contemplates that the center wall 54 could be secured within minor indentations in the sink walls themselves. In either embodiment, one or two clamping levers 129*e*, 129*f* can be provided on either the basin wall or center wall 52 to hold the center wall down tightly into the guide rails, or indentations, to seal the basins. The levers 129*e*, 129*f* can be fixed to the center wall 54 and can provide a hook to engage an aperture in the basin wall (not shown) and which by rotary lever action urge the center wall downwardly with respect to the basins.

Figure 2:
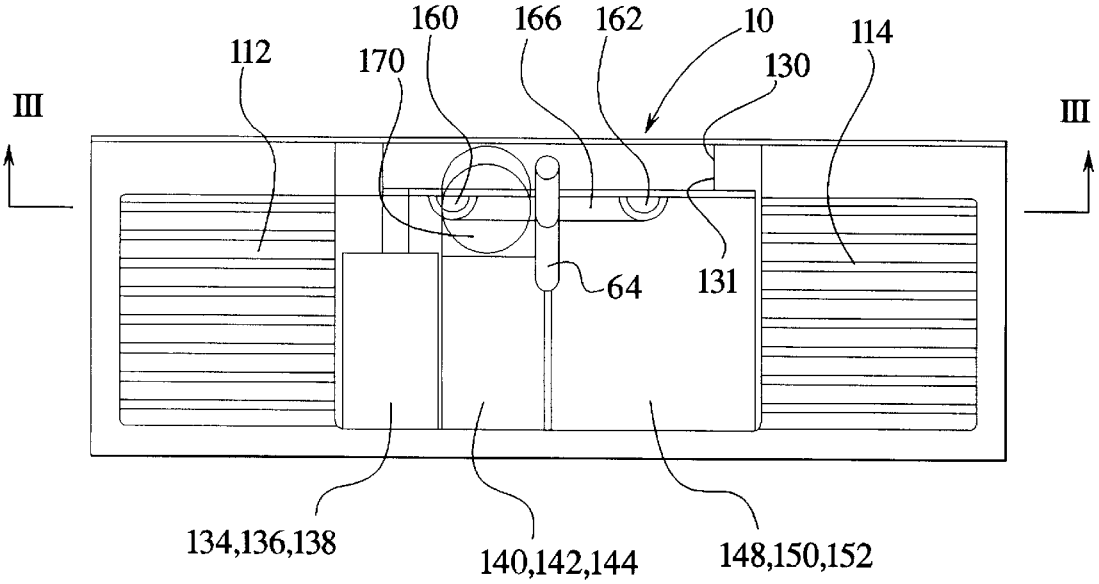
FIG. 2 is a top plan view of the work station of FIG. 1 with basins omitted for clarity.
Figure 4:
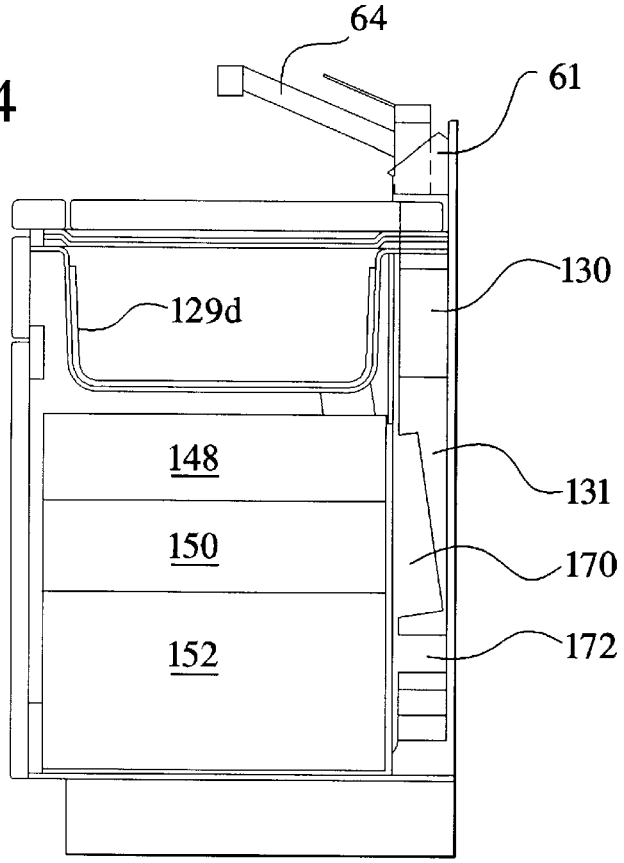
FIG. 4 is a sectional view taken generally along IV—IV of FIG. 3.

The center wall can be made dishwasher proof for easy cleaning. FIG. 2 shows a top of the appliance 10 with the console 60, control module 61 and the basins 50, 52 removed for clarity. A utilities module 130 having a plenum 131 is provided which contains the water feed and drain lines, disposer and trap. This module slides in and drops into a cut out at the back of the base cabinet 12. Within this module are the connections to the house water supply (hot and cold), drain and electric power source. These connections are made through an access door 132 in the plenum.

Figure 6:
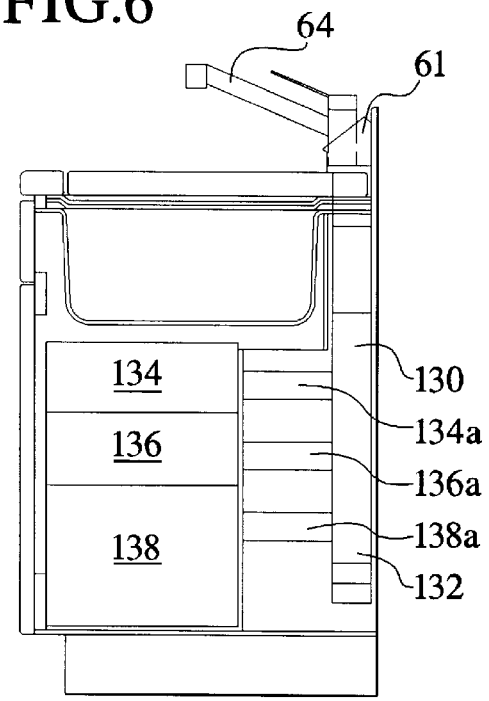
FIG. 6 is a sectional view taken generally along VI—VI of FIG. 3.
Figure 5:
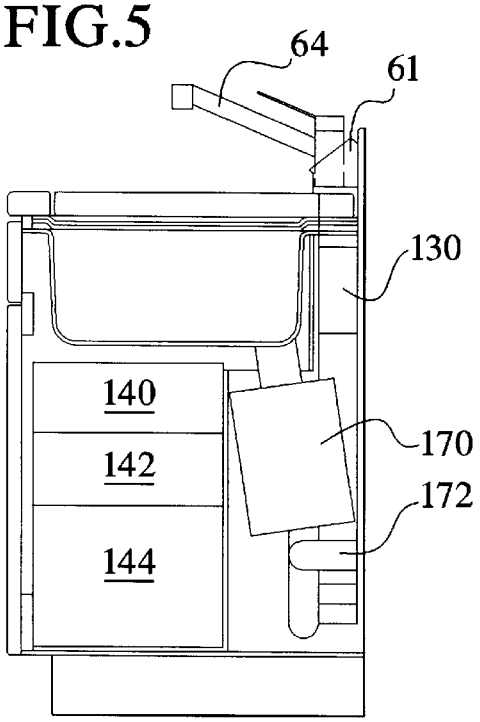
FIG. 5 is a sectional view taken generally along V—V of FIG. 3.

FIGS. 3–6 further describe the invention. Beneath the basins 50, 52 resides an area for plug-in modules 134, 136, 138; small storage bins 140, 142, 144 and large storage bins 148, 150, 152 respectively. The plug-in modules are arranged in front of an elongate portion 160 of the plenum 131 such that the plug-in modules can be connected simply with water, electricity, and signal lines to/from the control module 61. A series of connector conduits 134*a*, 136*a*, 138*a*, which can be preplumbed with inlet and outlet lines are shown in FIG. 6. These connector conduits 134*a*, 136*a*, 138*a* connect to the plenum 131 and associated water lines and electrical or signal lines, where applicable, are then connected to water, electrical, and signal lines 131*a*, 131*b*, 131*c*, 131*d* in the plenum. The water lines 131*a*, 131*b*, 131*c* in the plenum are shown dashed and connected to couplings 214, 216, 218 described below. The electrical and signal lines 131*d* are also shown dashed and connected to a plug 229 described below. Such modules can include a reverse osmosis system, a refrigerated bin for chilled vegetables and salads, a water temperature heater or refrigerator, an auto bulk soap dispenser, $CO_2$ water treatment, etc.

The small pull out storage bins 140, 142, 144 and the large storage bins 148, 150, 152 are advantageously sized to take advantage of the available area. By pre-plumbing the water and electricity within the plenum 131 at a back end of the appliance 10, more room is available beneath the basins for storage and plug in modules. Alternately, moveable dividers can be used instead of bins to maximize this storage area. Drains 160, 162 for the basins 50, 52 are located at back side of the basins located adjacent the back wall of the appliance 10 to maximize under basin room within the base cabinet 12. The drains 160, 162 are connected to a garbage disposer module 170 including a garbage disposer 171 by a drain manifold 166. Thus, both basins are serviced by one garbage disposer. The garbage disposer module 170 also has a trap 172 to be connected to house drain. The garbage disposer module 170 is thus preplumbed with the drain manifold 166 and trap 172 as an integral unit and is electrically powered by a connection into the utilities module plenum 131.

The control module 61 fastens directly to the utilities module 130 to maintain a tight integral construction. The control module can be made to fit tight against the house wall replacing the back splash or can be arranged for the back splash to interfit behind the module.

The wing modules 112, 114 provide space for water/wet food handling in the kitchen. They can be made available in a plurality of sizes including 15, 18 or 24 inches. The purchaser can select the appropriate size for either or both modules. They are placed at the edge of the basin module at installation and are secured with water proof glue or some other means. They can be the same material as the basin module. They sit over the adjacent cabinets drawer space and therefore are recessed below the counter. The wings can use all the counter space front to back so no counter top is needed, although a back splash can be used.

Figure 9:
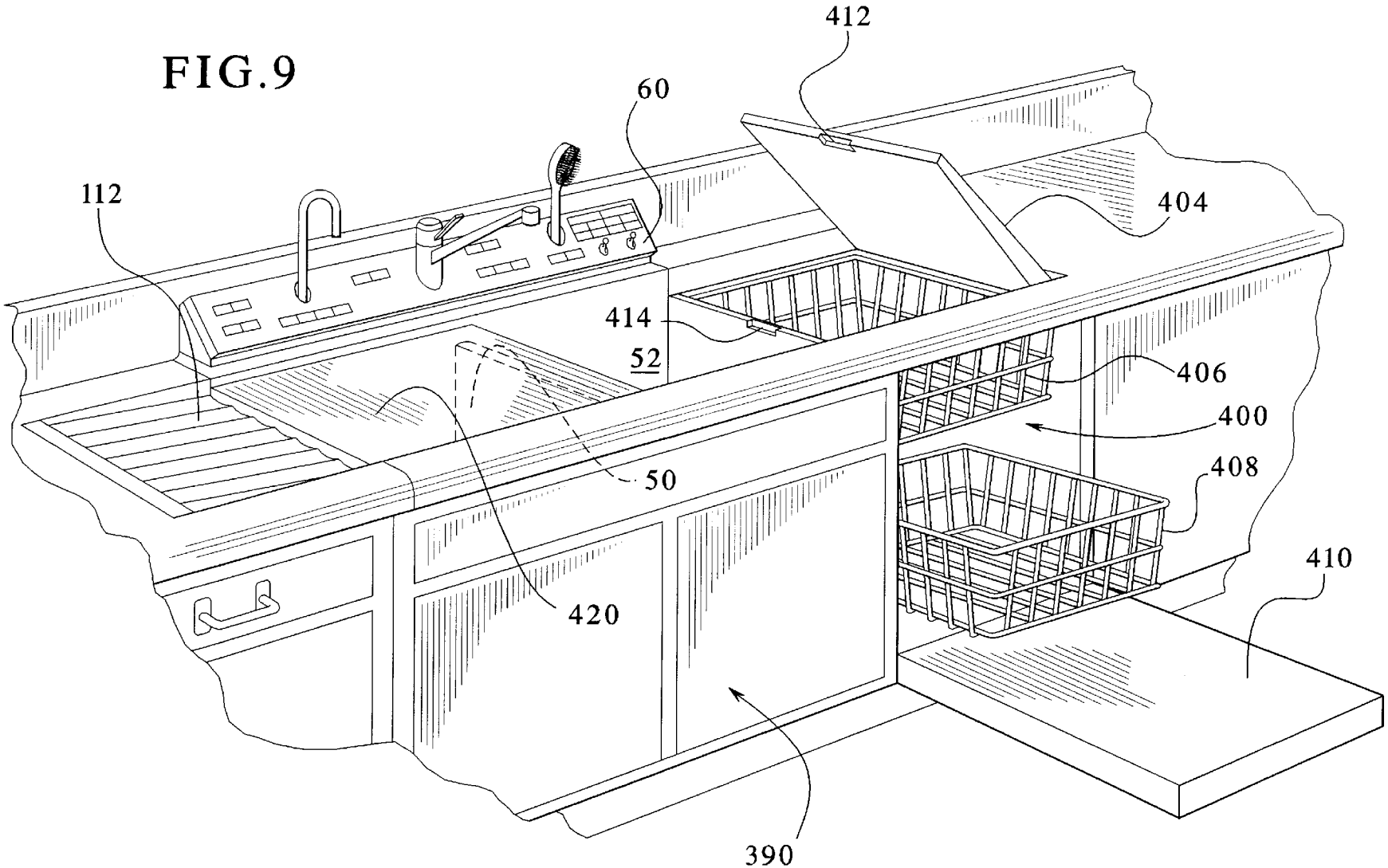
FIG. 9 is a further alternate arrangement of a water appliance and work station.

Sliding, reversible, removable covers can fit over the wings. The covers can be slid to cover the basins if desired as shown in FIG. 9. At least one of the wing covers can have foldable tines (not shown) on one surface to hold hand washed items. These wing covers can be manufactured in the counter top material (i.e., formica), wood or other cutting surface materials. The wing modules are available in a plumbed version including the nozzles 106. A flow of water is released from a series of these nozzles at the end of the wing module opposite the basin. The water then flows over the wing module to the basin and drain. The purpose is to assist in the flushing of food prep materials to the disposer and the general clean up of the wing module. The nozzles can also be elevated to flush the surface of a wing module cover in place on the wing module.

Figure 7:
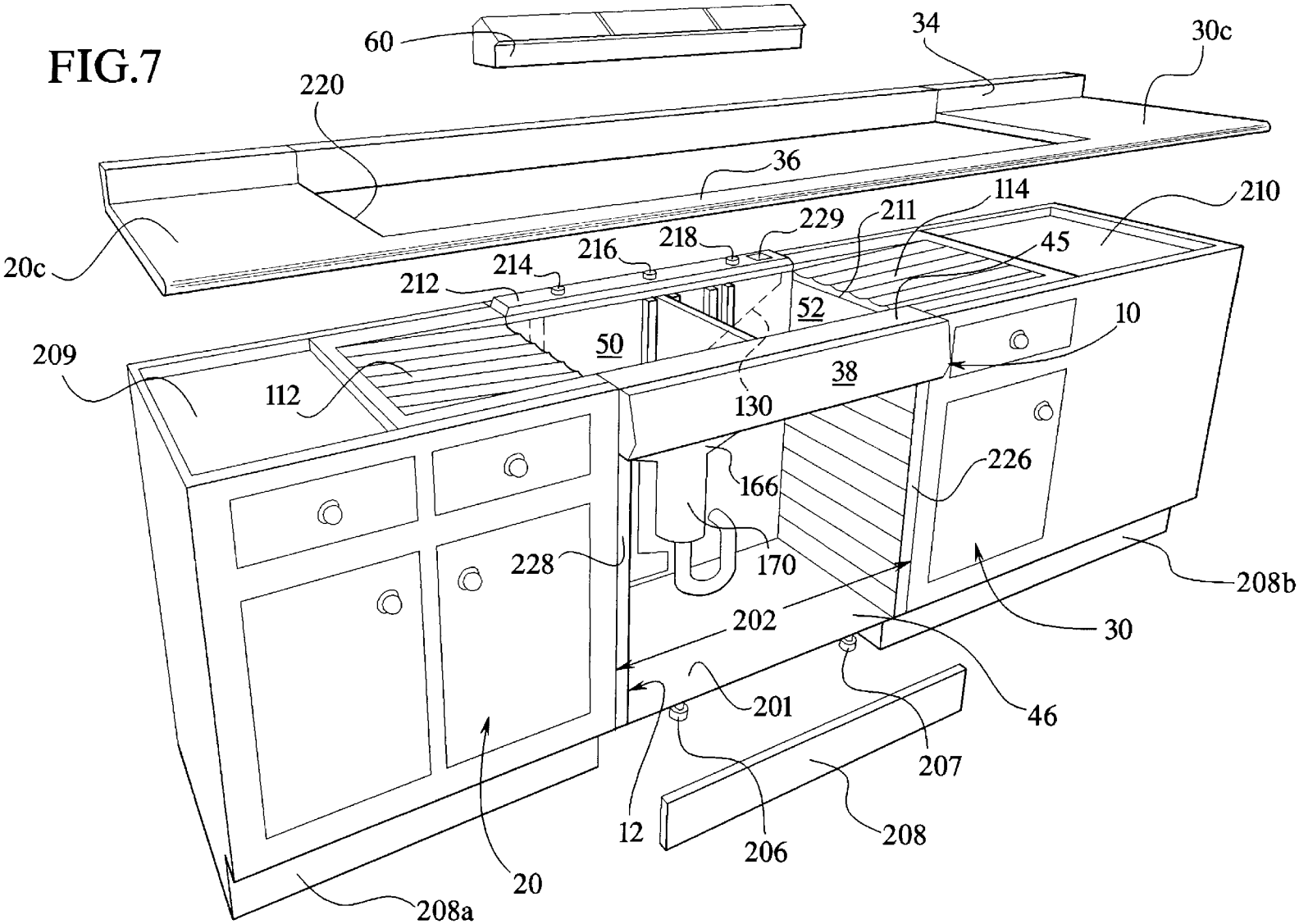
FIG. 7 is an exploded sectional view of the arrangement of FIG. 1 during assembly.

FIG. 7 shows the installation of the work station 10 adjacent the left cabinet 20 and the right cabinet 30. The base cabinet 12 having a base 201 is slid into a gap 202 between the left and right cabinets 20, 30. Alternatively the base cabinet 12 can be a lift and drop in appliance. Leveling legs 206, 207 at a front side, and further leveling legs at a back side (not shown) forming a rectangular grid are used to level the appliance 10 with respect to the cabinets 20, 30. The leveling leg arrangement is similar to other appliance leveling legs such as an oven. A decorative base plate 208 is applied to cover the underside of the cabinet base 12. This base plate can match the base boards 208*a*, 208*b* of the adjacent cabinets, if so desired, or simply may be of a standard kitchen appliance design. The cabinets 20, 30 receive within top recesses 209, 210, the wings modules 112, 114. The wing modules are secured there and can be arranged to snap fasten along an edge 211 to the basin 50, 52 along their edges. The utilities module is inserted through the slot 131 and fastened in place. A trim plate 212 covers the utilities module, the trim plate 212 having apertures for receiving the water connections 214, 216, 218. Next the counter top is placed down onto the cabinets 20, 30 and portions of the work station 10. The wing modules 112, 114 protrude through the counter opening 220 as do the basins 50, 52 and the trim plate 212. The control module 61 is then placed down onto the utilities module 130, particularly onto the trim plate 212 and the water connections 214, 216, 218 register with quick connect water couplings of the control module. These water conduits 214, 216, 218 service the drinking water faucet 66, the dispensing conduit 64 and the brush 78 respectively. Further connections can be provided as needed.

An electrical plug connector 229 registers with a compatible plug of the control module 61 when the control module 61 is meshed with the utilities module 130 (not shown). The utilities module 130 and the drain manifold 166 with the disposer module 170 all pre-plumbed can be installed together into the appliance. Next the cabinet doors are applied onto trim 226, 228 on a front of the base cabinet 12.

Figure 8:
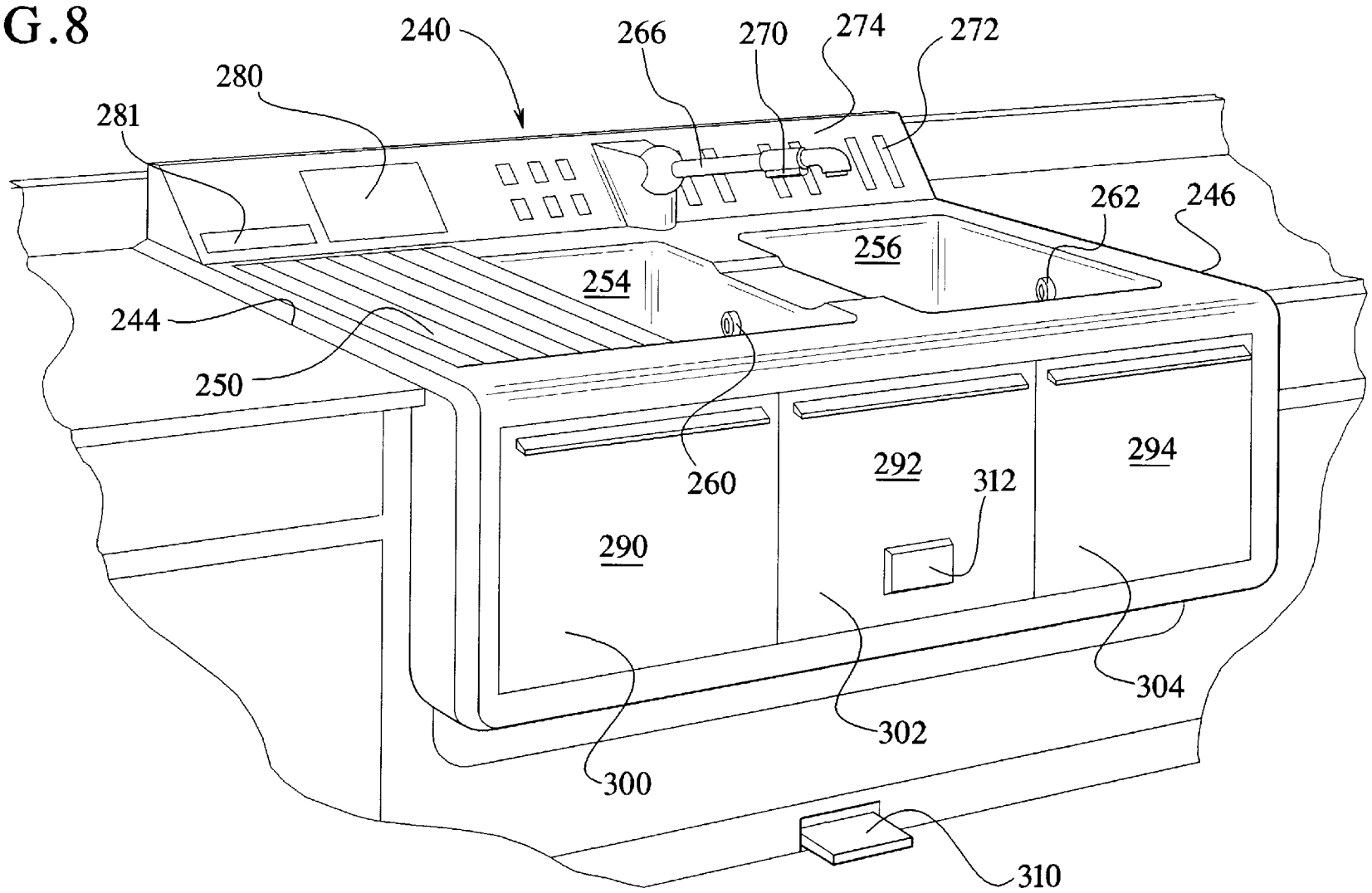
FIG. 8 is an alternate arrangement of a water appliance and work station.

FIG. 8 shows an alternate work station 240 having additional features. This station 240, shown without wing modules, fits adjacent cabinet counter tops 244, 246. A food preparation surface such as a cutting board 250 can be provided to overlay a first basin 254 and a second basin 256 respectively. The basins can be provided with jet wash nozzles 260, 262 for each basin for assisting in the cleaning of dishes and utensils. A dispensing conduit 266 includes a light activated sensor 270 for activating water flow. A plurality of controls are applied onto a control panel 274 of the station 240 as described for the previous embodiment. The controls can be waterproof, touch type controls. Additionally, this embodiment provides a display screen 280 which allows the playing of videotapes from a player 281, for entertainment while working, or for viewing recipes. The screen 280 can also be the output device of a personal computer, particularly one adapted for storing recipes. Other electronic conveniences such as radio or personal computing electronics can also be provided on the control panel 274.

On a front side of the station 240 are cabinet doors 290, 292, 294 respectively. For example, the cabinet door 290 can be used in conjunction with a pull out bin for chilled vegetables and salads, i.e., providing a small scale refrigerator. The cabinet door 292 can be used to access a wet/dry waste disposal with aerator systems. The cabinet door 294 can also be opened to access a reverse osmosis water purification system or a water filtering system.

As part of the electronics of the controller module 274, water temperature can be controlled electronically so that a preselected water temperature can be input. A default temperature can be selected such that when no input is received, the water maintains the default temperature. A soap dispenser can be actuated for sudsy or soapy water for cleaning, and water velocity can also be electronically controlled. All of the features of the first embodiment are also applicable to the second embodiment and vice versa. As with the first embodiment, the console 274 can be illuminated to provide working light in the basin area as well as to provide attractive light for the food preparation area. The light can be automatically turned on when the room becomes dark.

The work station can be installed with front cabinet panels 300, 302, 304 which match the kitchen cabinetry or can be provided with panels which match the appliances such as the kitchen refrigerator.

The dispensing conduit 266 can be electronically controlled to dispense exact amounts of water corresponding to the input amount. For example, the input of one-half cup will dispense exactly one-half cup from the dispenser conduit. Additionally, water velocity from the dispenser conduit 266 can be controlled for a constant flow rate to eliminate inadvertent splashing from high velocity water.

The water dispensing conduit 266 can be activated by a foot lever 310 or knee push bar 312 to free the workers hands for cleaning while the flow of water can be controlled.

The water appliance advantageously extends the full depth of the adjacent cabinetry such that there is no need for a "sink cut out." The appliance can provide a logical break in the counter top run. Long counter top pieces with rectangular sink cut outs can be avoided.

FIG. 9 illustrates a further embodiment of the invention, a workstation 390. A dishwasher appliance 400 is provided adjacent the basin 52. A pivotal wing module 404 is hingedly attached to cabinet structure of the dishwasher 400 to pivot upwardly to load dishes into a top rack 406. A bottom rack 408 can be accessed by a tilt down door 410. A latch arrangement 412, 414 between the basin 52 and the wing module 404 is provided to hold the module 404 closed during dishwashing. When pivoted down, the wing module 404 can be of any surface construction as described above for wing modules and can include conveniences such as water flush, heating element and plug in utilities also.

The work station 390, including the dishwasher 400, can be sold and installed as a unit, i.e., a single appliance.

Also shown in FIG. 9 is a cutting board 420 shown slid over the basin 50. This is particularly convenient as a means to cover dishes when so desired. This board can be free from the wing module 112 or can be guided for sliding movement therewith.

The board can be reversible with a dish drying surface including collapsible or foldable tines for vertical support of dishes, arranged thereon. The board 420 can thus be retracted back onto the wing module 112 to expose the basin 50. A similar or identical cutting board can be applied over the basin 52.

Although the present invention has been described with reference to a specific embodiment, those of skill in the art will recognize that changes may be made thereto without departing from the scope and spirit of the invention as set forth in the appended claims.

We claim:

1. A water appliance comprising:

a frame structure;

a water receiving and holding basin;

a utilities module including a surrounding plenum and water conduits extending from a top end of said plenum downwardly to water inputs;

a control module having a control console and mounted to a top of said utilities module, said control module having water delivery conduits arranged to register with said water conduits of said utility module when said control module is connected thereto, said control module having a water dispensing conduit extending over said basin, and controls for said water dispensing conduit mounted on said console; and wing modules extending from side walls of said basin wherein one of said wing modules comprises a heated cooking surface, said wing modules extending outwardly inclined upwardly to drain water downwardly to said basin.

2. The appliance according to claim 1 further comprising a disposer module including a mechanized garbage disposer, and having an inlet manifold, said basin including two spaced apart drain holes and said inlet manifold connected to said drain holes, and said disposer module having a piping trap configuration at an outlet of said mechanized garbage disposer.

3. The appliance according to claim 1, wherein one of said wing modules comprises a water delivery port connected to said utilities module.

4. The appliance according to claim 1, wherein said one of said wing modules comprises a plurality of flushing nozzles arranged to spray water along a surface of said wing module toward said basin for flushing debris therefrom.

5. The appliance according to claim 1, wherein said frame structure comprises leveling feet for setting the level of a top of said basin.

6. The appliance according to claim 1, wherein said frame structure comprises cabinet doors for alternately opening and closing a space beneath said basin.

7. The appliance according to claim 1, wherein said plenum comprises a an access panel for connecting functional modules to said water conduits, said functional modules including at least one device selected from the group consisting of a water heater, a water cooler, a water carbonation unit, a reverse osmosis water purifier, a water filter, and a source of detergent.

8. The appliance according to claim 1, wherein said control module comprises a control panel including controls for operating a dishwasher.

9. The appliance according to claim 1, wherein said plenum comprises an access panel for connecting functional modules to electricity, said functional modules including at least one selected from the group consisting of a reverse osmosis water purifier, a refrigerated bin, a water heater, a water cooler, a water carbonation unit, a garbage disposal unit.

10. The appliance according to claim 1, wherein said control module comprises a hand held brush having bristles and a flexible conduit connected thereto, said flexible conduit connected to one of said water conduits in said utilities module, said conduit delivering water through the bristles of said brush.

11. The appliance according to claim 10, wherein said flexible conduit is flow connected to a source of detergent.

12. The appliance according to claim 1, wherein said control module comprises a display screen for communicating information to a person working at the appliance.

13. The appliance according to claim 12, wherein said display screen is operably connected to one selected from the group consisting of a computer and a videotape player.

14. The appliance according to claim 1, wherein said control module comprises a selection circuit for controlling said water dispensing conduit to control one function selected from the group consisting of temperature, flow rate, measured quantity, $CO_2$ content, detergent content, purity content.

15. A control panel for a kitchen water appliance wherein:

said control panel extends upwardly from a supporting surface;

a water dispensing conduit extends through said control panel and outwardly over the supporting surface;

a plurality of control buttons are provided on said control panel, said control buttons electrically control wired to one device selected from the group consisting of a dishwasher, a water purification system, a garbage disposer, a water temperature control;

a cleaning tool is provided which connects to a flexible conduit, said conduit having an end connectable to a source of water and a cleaning end for manual engagement with an object to be cleaned by water, said cleaning tool having a handle portion connected to said conduit, said handle portion extending through said control panel to be held thereby in a standby position, and wherein said cleaning tool is a brush having at least one aperture for dispensing water through the bristles of said brush; and a second water delivery conduit extends through said control panel and over said work area, said second water delivery conduit connectable to a source of water, and said control module having control buttons for selecting the quality of said source of water including one selected from the group consisting of $CO_2$ content, purity content, temperature, flow rate, and measured quantity.

16. The control module according to claim 15, further comprising a video display screen and a control for said video display screen, said control being one selected from the group consisting of: a computer, a video tape player, and a television signal receiver.

17. A utilities module for connecting a water appliance to household utilities, comprising:

a rigid plenum extending from a counter level surface downward having a surrounding wall and an access panel, said plenum having a plurality of water carrying conduits extending from a top end downwardly to inlets connectable to sources of water; and an electrical conduit extending from a top end downwardly to connections arranged to connect to a household supply of electricity, said water conduits and electrical conduit arranged in a plane near said top end for connection to the sources of water and the household supply of electricity, respectively, at counter level.

18. The utilities module according to claim 17, wherein said access panel is accessible from a front of said appliance for connection to a water conditioning module including one selected from the group consisting of a water cooler, a water heater, a water purifier, a water filter, a water carbonator, and a detergent supply.

19. The utility module according to claim 17, further comprising an electronic control cable extending from a top end of said plenum down to behind the access panel for connection to another water appliance.

20. The utilities module according to claim 19, wherein said second water appliance is one selected from the group consisting of a dishwasher, a water purifier, a water heater, a water cooler, a garbage disposer, a refrigerator.

* * * * *